US006615526B2

(12) United States Patent
Pitcher et al.

(10) Patent No.: US 6,615,526 B2
(45) Date of Patent: Sep. 9, 2003

(54) FLAT PANEL DISPLAY APPARATUS

(75) Inventors: David E. Pitcher, Cambridge, MA (US); Thomas P. Burrous, Andover, MA (US)

(73) Assignee: Rose Displays, Ltd., Salem, MA (US)

( * ) Notice: Subject to any disclaimer, the term of this patent is extended or adjusted under 35 U.S.C. 154(b) by 0 days.

(21) Appl. No.: 09/820,264

(22) Filed: Mar. 28, 2001

(65) Prior Publication Data

US 2002/0139026 A1 Oct. 3, 2002

(51) Int. Cl.[7] ..... A47G 1/06
(52) U.S. Cl. ..... 40/790; 40/722
(58) Field of Search ..... 40/700, 720, 722, 40/790, 611

(56) References Cited

U.S. PATENT DOCUMENTS 479,004 A * 7/1892 Jacobson ..... 40/700
2,189,521 A * 2/1940 King ..... 40/700
3,178,841 A * 4/1965 Howell ..... 40/700
5,783,005 A * 7/1998 Handler ..... 156/73

* cited by examiner

*Primary Examiner*—S. Joseph Morano
*Assistant Examiner*—Robert J. McCarry, Jr.
(74) *Attorney, Agent, or Firm*—Don Halgren

(57) ABSTRACT

A frame panel apparatus for the ready presentation of flat media therein. The apparatus includes a flexible frame arranged to define a peripheral support for a display. An upper transparent panel having a periphery entirely enclosed by the flexible frame and a lower support panel having a periphery with a only a portion thereof supported by a shoulder member of the flexible frame support a display media therebetween.

13 Claims, 6 Drawing Sheets

FLAT PANEL DISPLAY APPARATUS

BACKGROUND OF THE INVENTION

1. Field of the Invention

This invention relates to horizontally displayed media presentations, and more particularly to a flat, maintainable, floor mountable, frame arrangement for displaying a readily changeable marketing message.

2. Prior Art

Successful marketing requires the ability to get people's attention. Media presentations and retail displays are often presented on the items themselves, hung on walls and from ceilings, or from some sort of a vertical stand in close proximity to the item on sale.

An area that has been basically overlooked by the people in the marketing and sales field, is that of floor presentations and displays. A concern of such floor presentation or display, however, is the requirement that such floor display be kept neat and clean, free from the obvious dirt and debris infiltration that would be indigenous to a floor disposed marketing arrangement. One such floor display arrangement may be seen in U.S. Pat. No. 6,022,599 to Rietveld et al. This '599 patent discloses a display unit, which however, is somewhat cumbersome to utilize and which maintains certain peripheral frame and panel portions open and susceptible to grime because of incomplete peripheral framing or support.

Further prior art is found in the form of a placemat having a clear plastic topmost sheet with a rubber lower layer. A three sided cut adjacent the periphery of the lower rubber layer permits a central flap to open downwardly, to receive an advertisement. The advertisement thus be seen through the top sheet. The lower sheet of rubber material is very flexible and will not support an inexpensive thin poster sheet of paper as an advertisement by itself. This is because this mat lacks a stiff backing-sheet and a protective peripheral frame edge for the back sheet support and for maintenance of cleanliness of the panel. Its display ad itself must be thick and stiff to make up for the flexible backing sheet, the changeable display ad therefore being expensive to produce because of its required thickness.

It is an object of the present invention to provide a floor panel and display arrangement that overcomes the disadvantages of the prior art.

It is a further object of the present invention to provide a floor panel and display arrangement that permits a simple and clean method of changing a paper-thin display poster within that frame arrangement.

It is a still further object of the present invention to provide a method of manufacturing a frame display arrangement, which is simpler and more convenient than the prior art.

BRIEF SUMMARY OF THE INVENTION

The frame panel display apparatus of the present invention comprises a preferably rectangular or square shaped peripheral frame molded of a soft, flexible, resilient material, such as rubber or the like.

The peripheral frame has a first end and a parallel second end. The peripheral frame also has a first side and a second side generally parallel to one another. The peripheral frame has an inner surface which includes a first inner peripheral slot. The first inner peripheral slot extends around the entire inner periphery of the frame. A transparent upper panel is preferably molded into the first peripheral slot during fabrication of the frame. The upper panel is of rectangular or square configuration and has its entire periphery supportively engaged in that first peripheral slot within the frame.

The frame, at its first end, has a shoulder portion, which includes a stepped groove, extending only along its first end, adjacent the inner periphery of the first slot thereat. The shoulder portion of the frame at its first end of the frame has an extended web disposed inwardly of the uppermost lip of the peripheral notch of the frame at the first end.

A lower back or support panel is disposed adjacent and is hingedly supported upon and by the shoulder portion of the frame only at its first end of the lower panel. The lower back support panel is narrower than the upper panel and is shorter than the upper panel so as to be readily arcuately displaceable therefrom, while the upper panel is supported within its peripheral inner groove of the frame.

The bottom back or support panel has a second end that is in close fitting but not engaging contact with the second end of the peripheral frame. The first side and the second side of the peripheral frame are also not in contacting engagement with the respective sides of the lower support panel, to permit that ready arcuate swinging of the lower support panel away from the upper panel, about their common first end thereof.

A plurality of anti-skid support pads are preferably arranged between the lowermost side of the bottom or lower panel so as to provide support to both the lower panel and the upper panel when they are disposed within the peripheral frame. Such support is necessary inasmuch as the frame panel assembly is intended to be placed on a floor or walking surface and actually stepped or walked upon. A further embodiment contemplates the panel assembly in use as a desk or countertop display.

A paper poster or thin display media may be inserted between the upper panel and the lower panel to present to pedestrians a marketing message beneath their feet within a commercial establishment.

In order to change the message, the second end of the peripheral frame may be lifted from the floor (or horizontal desk/counter) surface, while the bottom or lower panel remains in place against the floor. The initial poster or display may be removed and a new display sheet inserted therein. The stiff lower panel remains securely in place within the first end of the frame assembly by virtue of the extended web portion comprising the receiving shoulder at the first end of the frame assembly in which the lower panel is received and secured thereat.

During manufacture of the frame assembly, the upper transparent panel and the lower support panel are juxtaposed together, and placed in a mold so that the first end of the peripheral frame encapsulates the first transverse end of the lower support panel and it encapsulates and seals therewith, the entire periphery of the upper transparent panel therearound. A spacer element may be integral with the mold or placed around the second end and sides of the lower panel in the mold to maintain that slight second end and side gap between the lower panel and the inner edge of the soft frame.

A further embodiment of the present invention contemplates the embedding of magnets within the lower periphery of the peripheral frame during the molding process to permit such a frame display apparatus to be more securely utilized on a metal surface, such as a desk, floor, or wall.

Thus, what has been shown is a novel panel assembly, particularly suited for a floor display presentation wherein the thin inexpensive media presented for display may be readily changed and maintained in a cleaner and more secure frame environment than the prior art. A mop or other wiper and fluid may readily be applied to clean the present frame panel apparatus because of the fully sealed nature of the peripheral frame and the upper panel supported therein, a feature not found in the prior art.

The invention thus comprises a frame panel apparatus for the ready presentation of flat media therein, comprising a flexible frame arranged to define a peripheral support for a display, an upper transparent panel having a periphery entirely enclosed by the flexible frame, and a lower support panel having a periphery with a only a portion thereof supported by a shoulder member of the flexible frame. The frame is of rectilinear configuration. The shoulder member extends across a first end only, of the flexible frame. The upper panel is disposed in a sealing slot on an inner surface of the frame. The lower panel is shorter and narrower than the upper panel to permit ready arcuate separation therebetween. The lower panel is hingedly supported at a first end thereof, to a first end of the frame. The lower panel has a lower surface with an arrangement of support pads thereon, the support pad arrangement providing support for both the lower and the upper panel. The upper panel and the lower panel are in close juxtaposition with respect to one another. The flat media is pressed snugly between the upper panel and the lower panel for visual presentation therefrom, and for cleanliness of appearance.

The invention also includes a method of presenting a visual display as a floor assembly, comprising the steps of: arranging a flexible peripheral frame about the entire periphery of a transparent upper panel; securing a first end of a lower support panel in a first end of the frame, beneath the upper frame; placing support pads on a bottom side of the lower support panel to support both the lower and the upper panel; pivotably lifting up the frame and the upper panel about a first end of the frame; inserting a display media between the upper and lower panels; and lowering the upper panel and frame onto the lower panel to secure the upper and lower panels in a snug sealed display presenting relationship. The method may include the steps of: arranging an extended web on the first end of the frame to support the first end of the lower panel; placing an arrangement of magnets in the frame for improving securement thereof the a metal surface; and wherein the frame is molded from rubber.

BRIEF DESCRIPTION OF THE DRAWINGS

The objects and advantages of the present invention will become more apparent, when viewed in conjunction with the following drawings in which.

DETAILED DESCRIPTION OF THE PREFERRED EMBODIMENTS

Figure 1:
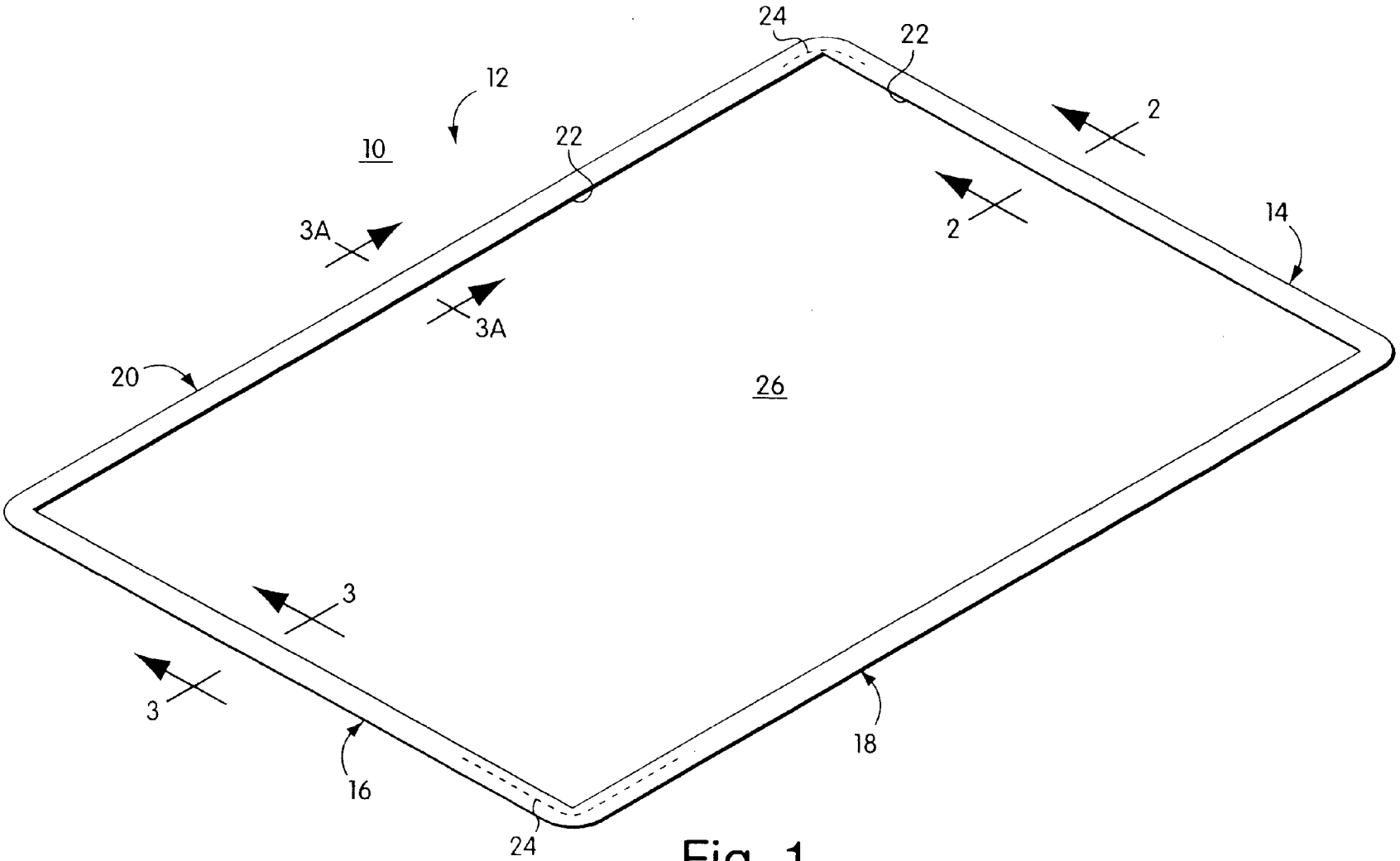
FIG. 1 is a perspective view of a frame panel display apparatus constructed according to the principles of the present invention.

Referring now to the drawings in detail, and particularly to FIG. 1, there is shown the present invention which comprises a frame panel display apparatus 10 that includes a preferably rectangular or square shaped peripheral frame 12 molded of a soft, flexible, resilient material, such as rubber or the like.

Figure 2:
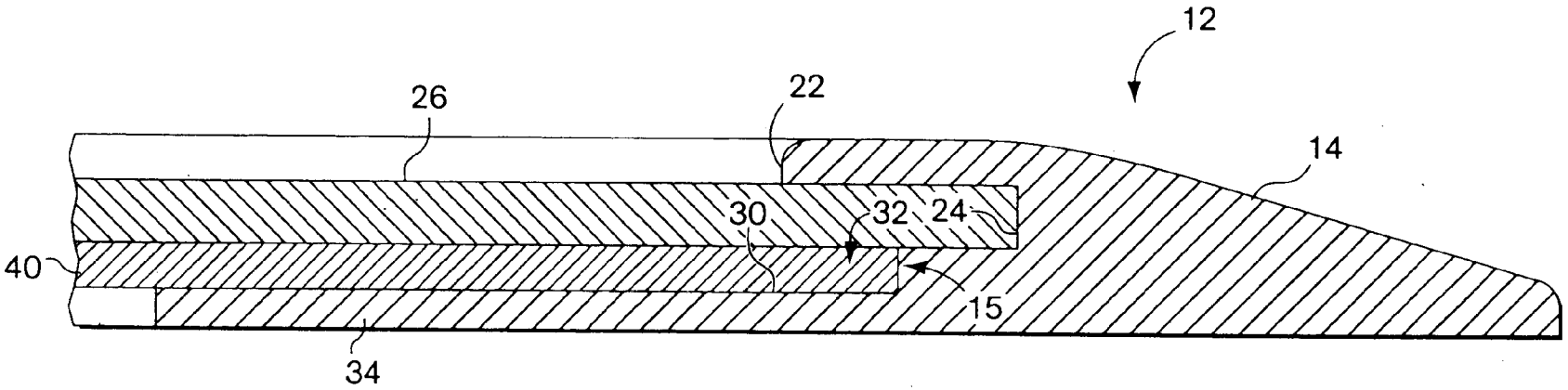
FIG. 2 is a view taken along the lines 2—2 of FIG. 1.

The peripheral frame 12 has a first end 14 and a parallel second end 16. The peripheral frame also has a first side 18 and a second side 20 that are generally parallel to one another. The peripheral frame 12 has an inner surface 22 which includes a first inner peripheral slot 24, as may be seen in FIG. 2. The first inner peripheral slot 24 extends around the entire inner periphery of the frame 12 and may be seen in FIGS. 2 and 3. A transparent upper panel 26 is preferably molded into and sealed within the first peripheral slot 24 during molding fabrication of the frame 12. The upper panel 26 is of corresponding rectangular or square configuration and thus has its entire periphery supportively engaged and sealed in that first peripheral slot 24 within the frame 12.

The frame 12, at its first end 14, has a shoulder portion 30, which includes a stepped groove 32, extending only along its first end 14, adjacent the inner periphery of the first slot 24 thereat, as is shown in FIG. 1. The shoulder portion 30 of the frame 12 at its first end 14 of that frame 12 has an extended web 34 disposed inwardly of the inner surface 22 of the peripheral slot 24 of the frame 12 at its first end 14.

Figure 3A:
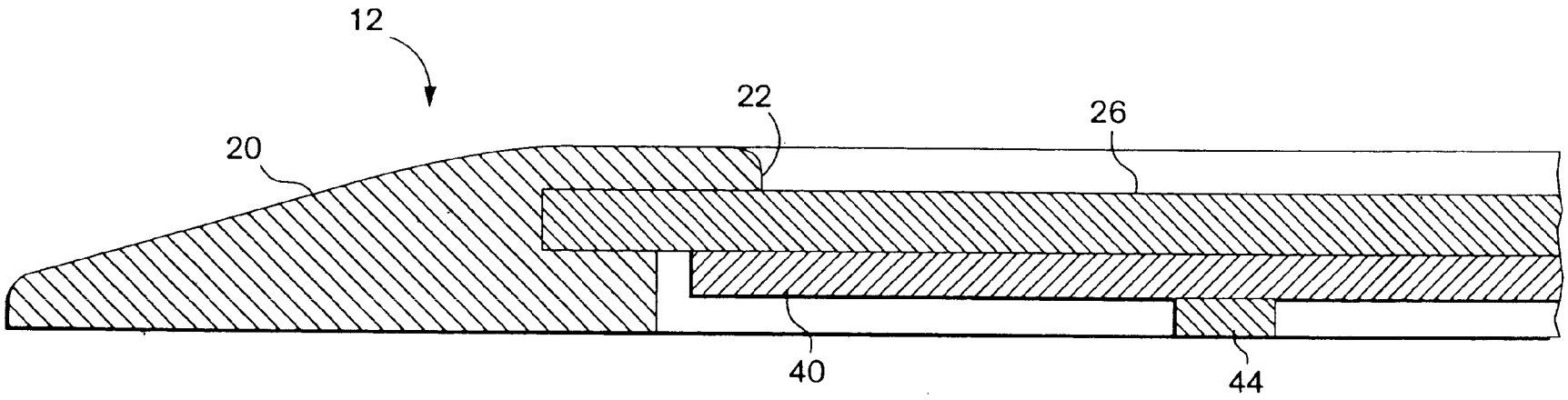
FIG. 3*a* is a view taken along the lines 3*a*—3*a* of FIG. 1.
Figure 3:
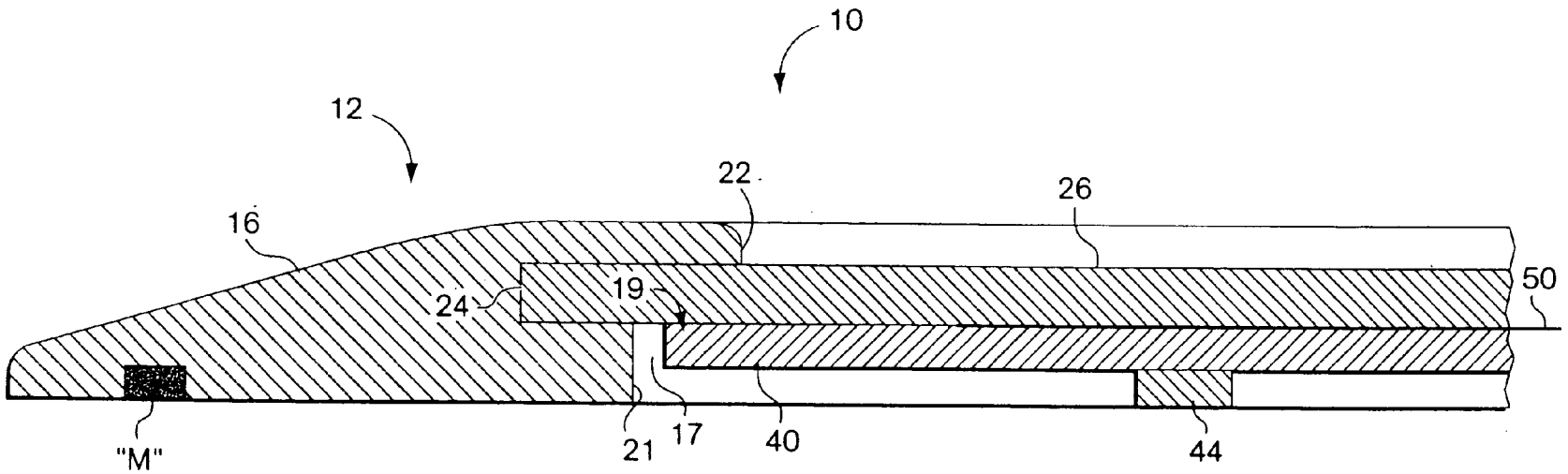
FIG. 3 is a view taken along the lines 3—3 of FIG. 1.

A lowermost backing or support panel 40 is disposed adjacent the upper panel 26 and is hingedly supported upon and by the shoulder portion 30 of the frame 12 only at its first end 14. The lower support panel 40 is narrower than the upper panel 26, as is represented in FIG. 3*a*, and is shorter than the upper panel 26, as may be seen from FIG. 3, so that they may be readily arcuately displaceable from one another, while the upper panel 26 is supported within its peripheral inner groove 24. The bottom panel 40 has a second end 42 that is in close fitting but not restrictive engaging contact with the second end 16 of the peripheral frame 12, as shown in FIG. 3. The inner edge surface 22 of the first side 18 and the second side 20 of the peripheral frame 12 are also not in contacting engagement with the respective sides of the lower panel 40 to permit that ready arcuate swinging away of the lower panel 40 relative to the upper panel 26, about the first end 14 thereof.

Figure 4:
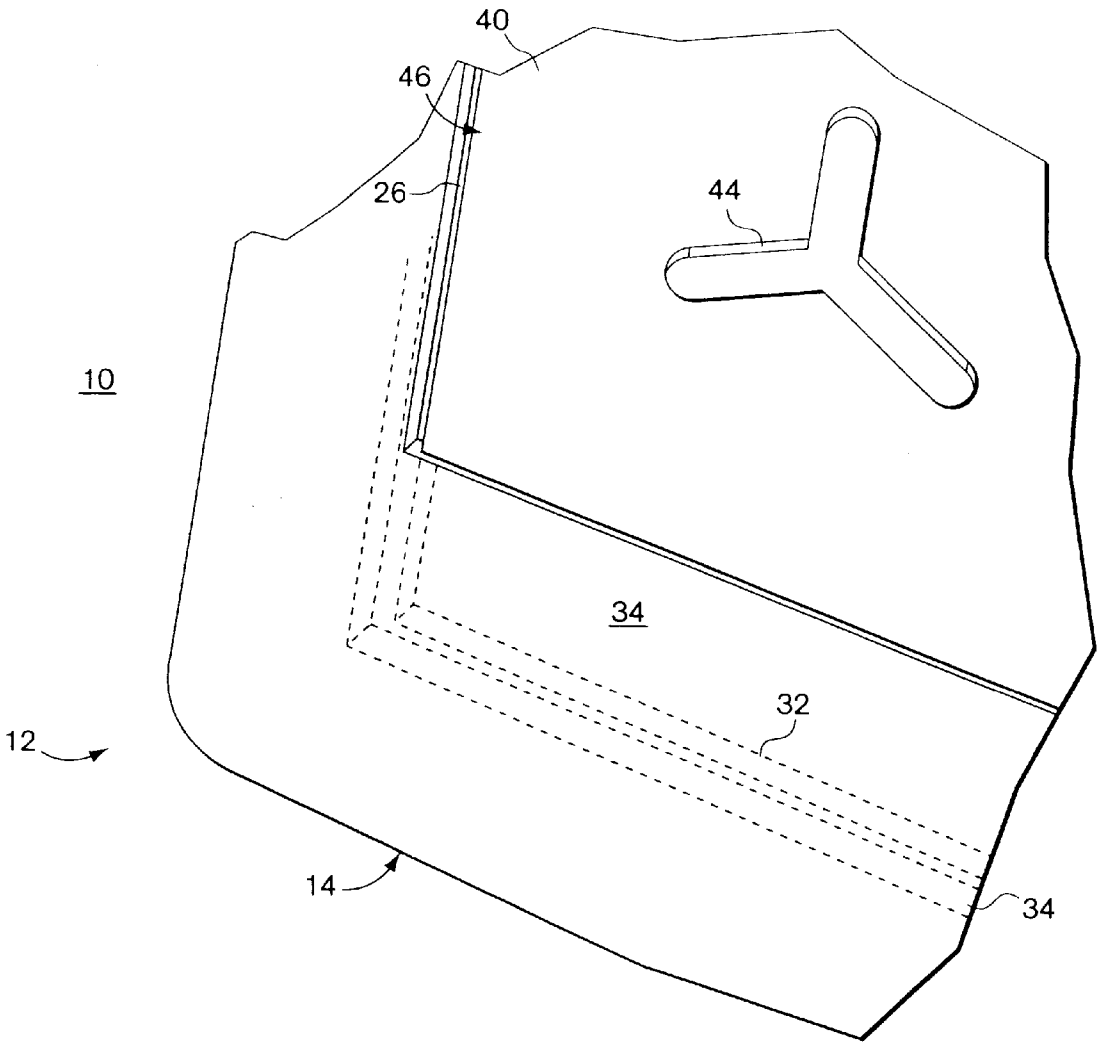
FIG. 4 is a perspective view of a portion of the lower side of the frame display apparatus of the present invention.
Figure 5:
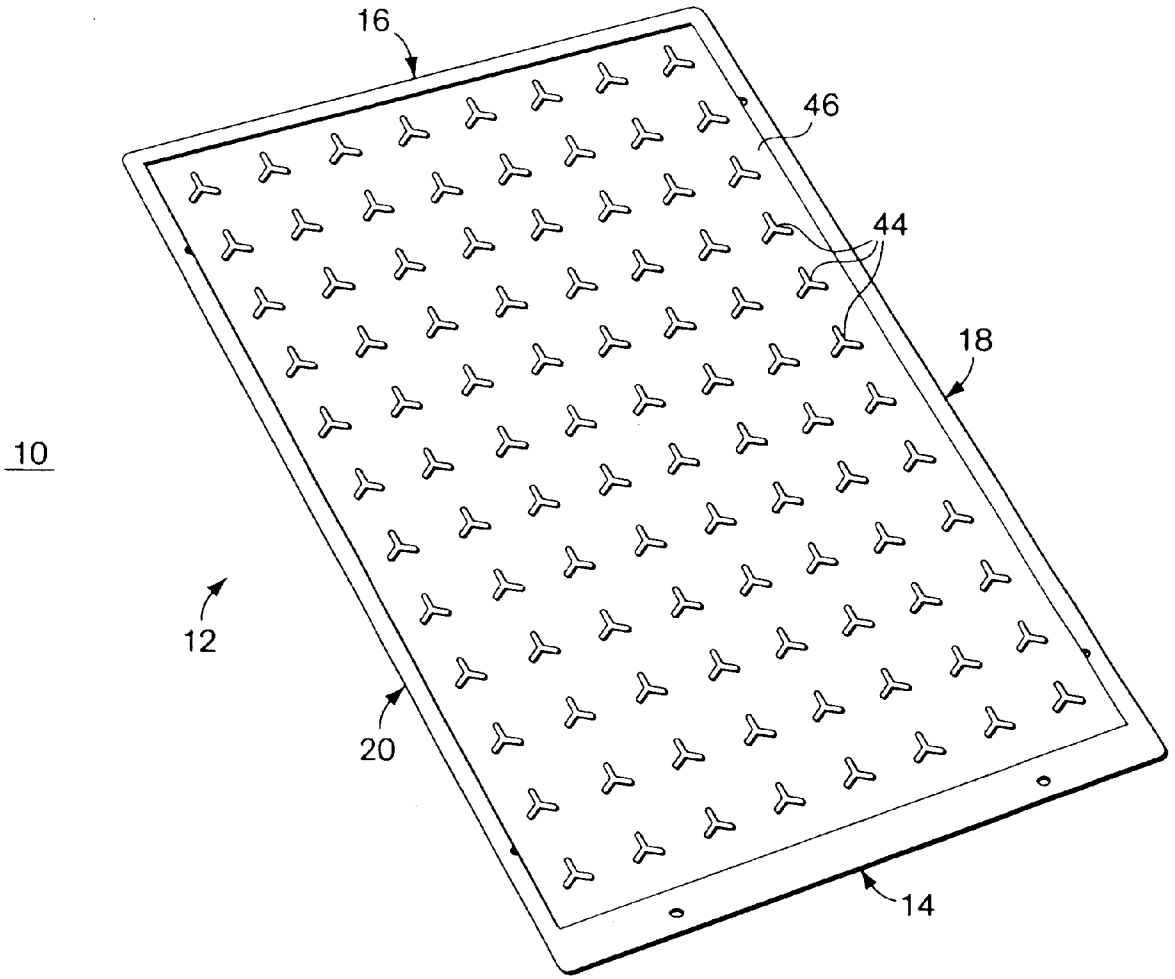
FIG. 5 is a perspective view of the entire floor panel display arrangement, showing its lowermost side thereof.

A plurality of anti-skid support pads 44 may be preferably arranged between the lowermost side 46 of the bottom or lower panel 40, as shown in FIGS. 3, 4 and 5, so those pads 44 may provide support to both the lower panel 40 and the adjacently overlaying upper panel 26 when they are both disposed within the peripheral frame 12. Such support is necessary inasmuch as the frame panel assembly 10 is intended in a first preferred embodiment to be placed on a floor or walking surface and actually stepped or walked upon.

A sheet of paper poster or thin display media 50, as represented in FIG. 3, may be inserted between the upper panel 26 and the lower panel 40 to present to pedestrians a marketing message within the frame apparatus 10 which may be arranged for example on the floor beneath their feet as they enter a commercial establishment.

In order to change the message (paper poster 50), the second end 16 of the peripheral frame 12 may be lifted from the floor surface and pivoted about its first end 14, while the bottom or lower panel 40 remains in place against the floor. The initial poster sheet or display 50 may be removed and a new display sheet inserted therein. The lower panel 40 remains securely in place within the first end 14 of the frame assembly 10 by virtue of the frictional engagement of the extended web portion 34 and the receiving shoulder 30 at the first end 14 of the frame assembly 10 in which the lower panel 40 is received and secured thereat.

During manufacture of the frame assembly 10, the upper transparent panel 26 and the lower support panel 40 are juxtaposed together, and placed in a mold, not shown for clarity, so that the first end 14 of the peripheral frame 12 encapsulates the first transverse end 15 of the lower support panel 40 and it also encapsulates the entire periphery of the upper transparent panel 26 therearound. A spacer element 17 which may be integral to the mold or may be placed around the second end 19 and sides of the lower panel 40 in the mold to maintain that slight second end and side gap between the lower panel 40 and the inner edge 21 of the resilient frame 12.

A further embodiment of the present invention contemplates the embedding of magnets "M" within the lower periphery of the peripheral frame 12, as shown in FIG. 3, during the molding process to permit such a frame display apparatus 10 to be more securely utilized on a metal surface, such as a desk, floor, or wall.

Thus, what has been shown is a novel panel assembly, particularly suited for a cleanable floor display presentation wherein the media presented for display may be readily changed and maintained in a cleaner and more secure frame environment than the prior art. Such panel assembly being utilizable as a countertop or desktop display, in a further embodiment thereof.

We claim:

1. A frame panel apparatus for the ready presentation of flat media therein, comprising:

a flexible frame arranged to define a peripheral support for a display;

an upper transparent panel having a periphery entirely enclosed by said flexible frame; and a lower support panel having a periphery with a only a portion thereof supported by a shoulder member of said flexible frame, said shoulder member extending across a first end only, of said flexible frame to permit ease of access to said flat media thereadjacent.

2. The frame panel apparatus as recited in claim 1, wherein said frame is of rectilinear configuration.

3. The frame panel apparatus as recited in claim 1, wherein said upper panel is disposed in a sealing slot on an inner surface of said frame.

4. The frame panel apparatus as recited in claim 1, wherein said lower panel is shorter and narrower than said upper panel to permit ready arcuate separation therebetween.

5. The frame panel apparatus as recited in claim 4, wherein said lower panel is hingedly supported at a first end thereof, to a first end of said frame.

6. The frame panel apparatus as recited in claim 1, wherein said lower panel has a lower surface with an arrangement of support pads thereon, said support pad arrangement providing support for both said lower and said upper panel.

7. The frame panel apparatus as recited in claim 6, wherein said upper panel and said lower panel are in close juxtaposition with respect to one another.

8. The frame panel apparatus as recited in claim 7, wherein said flat media is pressed snugly between said upper panel and said lower panel for visual presentation therefrom, and for cleanliness of appearance.

9. A method of presenting a visual display as a floor assembly, comprising the steps of:

arranging a flexible peripheral frame about the entire periphery of a transparent upper panel;

securing a first end of a lower support panel in a shoulder member extending across only a first end of said frame, beneath said upper frame;

placing support pads on a bottom side of said lower support panel to support both said lower and said upper panel;

pivotably lifting up said frame and said upper panel about a first end of said frame;

inserting a display media between said upper and lower panels; and lowering said upper panel and frame onto said lower panel to secure said upper and lower panels in a snug sealed display presenting relationship.

10. The method as recited in claim 9, including the step of:

arranging an extended web on said first end of said frame to support said first end of said lower panel.

11. The method as recited in claim 10, including the step of:

placing an arrangement of magnets in said frame for improving securement thereof the a metal surface.

12. The method as recited in claim 9, wherein said frame is molded from rubber.

13. A frame panel apparatus for the ready presentation of flat media therein, comprising:

a flexible frame arranged to define a peripheral support for a display;

an upper transparent panel having a periphery entirely enclosed by said flexible frame;

a lower support panel having a periphery with a only a portion thereof supported by a shoulder member of said flexible frame, wherein said frame is of rectilinear configuration, said shoulder member extending across a first end only, of said flexible frame, said upper panel being disposed in a sealing slot on an inner surface of said frame;

said lower panel being shorter and narrower than said upper panel to permit ready arcuate separation therebetween, said lower panel being hingedly supported at a first end thereof, to a first end of said frame, said lower panel having a lower surface with an arrangement of support pads thereon, said support pad arrangement providing support for both said lower and said upper panel and wherein said upper panel and said lower panel are in close juxtaposition with respect to one another, whereby said flat media is pressed snugly between said upper panel and said lower panel for proper visual presentation therefrom, and for cleanliness of appearance.

* * * * *